United States Patent [19]

Courtois

[11] 4,000,591

[45] Jan. 4, 1977

[54] HOLDER ADAPTED FOR SUPPORTING AN ANCHOR INSERT TO BE EMBEDDED IN A CONCRETE SLAB

[75] Inventor: Peter D. Courtois, Oceanside, Calif.

[73] Assignee: Superior Concrete Accessories, Inc., San Diego, Calif.

[22] Filed: Aug. 4, 1975

[21] Appl. No.: 601,301

[52] U.S. Cl. ..... 52/125; 52/698; 52/707

[51] Int. Cl.[2] ..... E04B 1/38; E04B 1/60

[58] Field of Search ..... 52/125, 677, 678, 679, 52/680, 681, 682, 683, 684, 685, 686, 687, 689, 698, 699, 701, 704, 705, 706, 707, 708, 709, 710, 711, 712, 713, 714, 715; 294/89

[56] References Cited

UNITED STATES PATENTS

| | | | |
|---|---|---|---|
| 1,260,331 | 3/1918 | Collings | 52/707 |
| 1,870,487 | 8/1932 | Bitney | 52/688 |
| 1,871,809 | 8/1932 | Lampert | 52/688 |
| 3,022,971 | 2/1962 | Cote | 52/711 |
| 3,124,385 | 3/1964 | Neptune | 294/89 |
| 3,195,278 | 7/1965 | Ballou | 52/125 |
| 3,429,607 | 2/1969 | White | 294/89 |
| 3,431,012 | 3/1969 | Courtois | 52/125 |
| 3,590,538 | 7/1971 | Holt | 52/125 |

FOREIGN PATENTS OR APPLICATIONS

| | | | |
|---|---|---|---|
| 712,706 | 3/1931 | France | 52/125 |
| 152,834 | 8/1920 | United Kingdom | 52/688 |

*Primary Examiner*—Price C. Faw, Jr.
*Assistant Examiner*—William Randolph
*Attorney, Agent, or Firm*—Norman H. Gerlach

[57] ABSTRACT

A holder adapted for supporting an anchor insert to be embedded in a concrete slab, such insert including a shank having an enlarged disc-like foot on one end thereof, the holder comprising an enclosure, a plurality of legs extending from the enclosure, and a foot at the outer end of each leg and adapted with the remaining feet to support the enclosure in spaced relation above the floor of a concrete form, such enclosure including a seat adapted for supporting an insert with the foot of the insert seated thereon, and means adapted to engage the insert when supported on the seat for limiting tilting movement of the insert.

5 Claims, 9 Drawing Figures

HOLDER ADAPTED FOR SUPPORTING AN ANCHOR INSERT TO BE EMBEDDED IN A CONCRETE SLAB

BACKGROUND OF THE INVENTION

This invention relates to apparatus for lifting and handling precast concrete, such apparatus including an anchor insert embedded in a concrete body for engagement with a lifting member having means for attachment to a crane cable or the like for lifting the concrete body. More particularly, the invention pertains to a holder adapted for supporting an anchor insert to be embedded in a concrete slab.

An anchor insert as contemplated by the invention and a representative lifting member employed therewith are disclosed in U.S. Pat. No. 3,499,676. The anchor insert is an elongated member including a shank having an enlarged disc-like foot on one end thereof and, in such embodiment, an enlarged head on the opposite end of the shank for connection to the lifting member. The anchor insert is embedded in a concrete body with its head end projecting therefrom. The foot of the insert serves to anchor it in the concrete, while the head is accessible for connection to the lifting member in lifting the concrete body thereby.

In use of the system illustrated in the above-identified patent, the anchor inserts when employed in a concrete slab or panel being cast horizontally preferably are positioned after placing the concrete. More particularly, each insert is "floated" from a small board resting on the surface of the wet concrete: the head of the insert is enclosed in a rubber plug which is connected to the undersurface of the board, and the remainder of the insert extends downwardly therefrom into the concrete. After the concrete has set, the board and the plug are removed, leaving the insert head exposed in a recess or depression formed in the slab by the plug.

The foregoing method of setting the anchor inserts has certain disadvantages: it is necessary in casting large slabs that the workmen walk over the slabs in order to place the inserts, and this is undesirable. It would be preferable to place the inserts when setting up the form, and before pouring the concrete. Also, the prior float board interferes with screeding therebeneath, and it may leave a recess in the surface of the slab which cannot be finished or decorated in the same manner as the surrounding surface of the slab. Moreover, extra work is required to cast slabs in stacks, one on top of another, inasmuch as the board and the plug must be removed from each insert, and the recess formed by the plug must be filled temporarily, after casting each slab and before casting the next slab in the stack. It would be desirable to provide a means of placing the anchor inserts that would minimize interference with screeding and would also permit casting of one slab on top of another in a stack without need for intervening preparation of the surface of the panel at the location of each insert.

SUMMARY OF THE INVENTION

The present invention provides a holder adapted for supporting an anchor insert to be embedded in a concrete slab, such insert including a shank having an enlarged disc-like foot on one end thereof, the holder comprising, in combination, an enclosure, a plurality of legs extending from the enclosure, and a foot at the outer end of each leg and adapted with the remaining feet to support the enclosure in spaced relation above the floor of a concrete form, such enclosure including a seat adapted for supporting an insert with the foot of the insert seated thereon, and means adapted to engage the insert when supported on the seat for limiting tilting movement thereof. Preferably, the enclosure also includes means adapted to engage the insert when supported on the seat for restraining the insert against lateral movement off of the seat.

In a preferred embodiment of the invention, the enclosure is a box-like structure including top and bottom walls joined together by side walls, the bottom wall providing a seat for the foot of the insert, means defining an entrance opening for lateral insertion of the foot into the enclosure to seat on the bottom wall, and means defining a slot in the top wall communicating with the entrance opening to accommodate the shank of the insert as the foot is inserted in the enclosure.

Additionally preferred structure in the foregoing embodiment includes a ledge provided on the bottom wall, the ledge extending across the entrance opening for retaining the foot of the insert within the enclosure. Means are provided in the enclosure forming a pocket opposite to the entrance opening and substantially conforming to the configuration of the foot of the insert, such pocket-forming means serving to limit tilting movement of the insert relative to the holder.

In another preferred embodiment of the invention, the enclosure is a wire cage-like structure including a seat section providing a seat for the foot of the insert, and two spaced-apart arms supported on the seat section and receiving the shank of the insert therebetween when the insert is supported on the seat section. Preferably, the arms are bent to engage the shank for limiting tilting movement of the insert when supported on the seat section and for restraining the insert against lateral movement off of the seat section.

The holder provides a means for supporting an anchor insert on the floor or comparable surface in a concrete form for a slab or panel being cast horizontally. Inserts may be located accurately as the form is set up. Moreover, the inserts may be located most advantageously with respect to reinforcing bars, and wired thereto, in setting up the form. When the slab is cast, there is no need to walk over the wet concrete or work the inserts into the concrete mass.

The inserts may be emplaced in the concrete slab so that they do not interfere substantially with screeding, and a desired finish may be provided on the slab except for a small area at the insert. The head of the insert may be covered during casting in such a way as to permit the head ultimately to be covered with grout and suitably finished. The head covering also may be left in place when slabs are cast in stacks, and subsequently removed from the inserts in each slab to enable the inserts to be connected to the lifting elements. In this manner, slabs may be cast successively, one on top of another, with no need to remove insert supporting members and temporarily fill recesses prior to pouring one slab on top of another.

The holder is a simple, lightweight and economical unit, well-adapted for manufacture and use in quantity. The holder may be made in a number of different sizes, to accommodate different insert sizes and slab thicknesses.

BRIEF DESCRIPTION OF THE DRAWINGS

The attached drawings illustrate preferred embodiments of the invention, without limitation thereto. In the drawings, like elements are identified by like reference symbols in each of the views, and.

DESCRIPTION OF THE PREFERRED EMBODIMENTS

Figure 1:
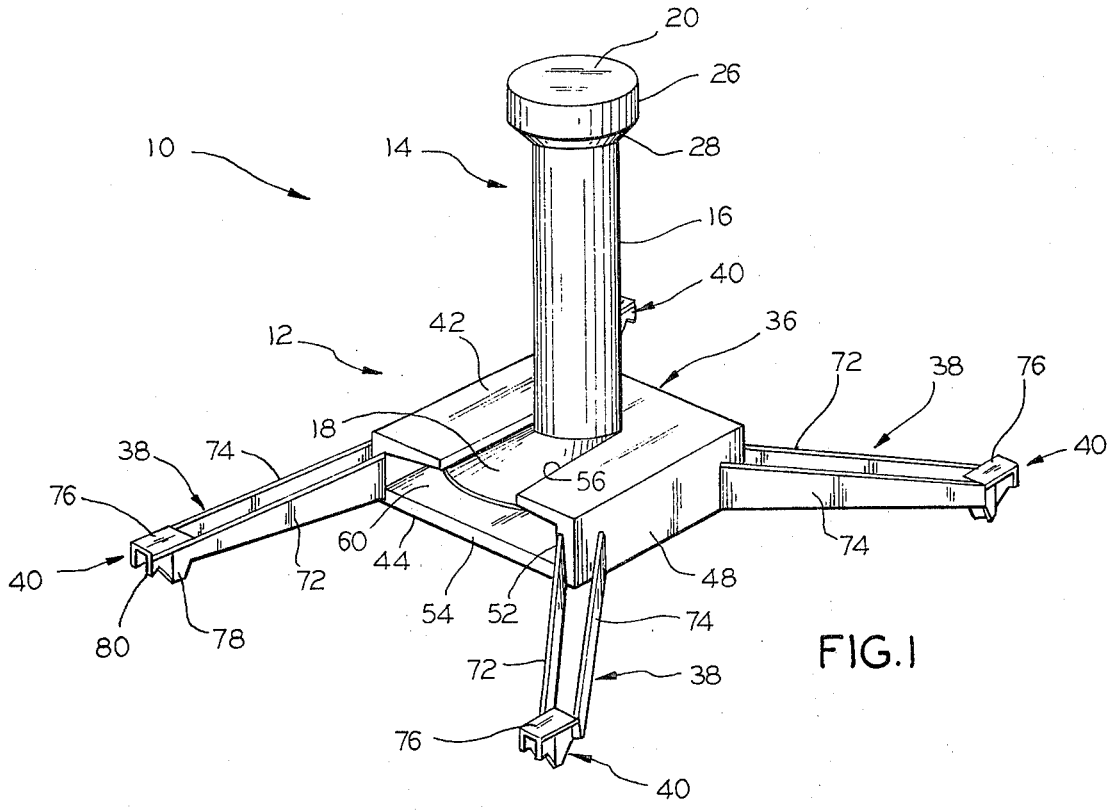
FIG. 1 is a front and side perspective view of an assembly of one embodiment of the new holder and an anchor insert mounted thereon.

Referring to the drawings, FIGS. 1–4 illustrate an assembly 10 of a holder 12 and an anchor insert 14 mounted on the holder, according to one preferred embodiment of the invention. The anchor insert 14 is of the type disclosed in U.S. Pat. No. 3,499,676. It is designed for cooperation with a lifting or coupling member, such as the lifting member described in the patent.

The anchor insert 14 is an elongated preferably steel member including a cylindrical shank, shaft or stem 16, an enlarged circular disc-like foot 18 integral with one end of the shank, and an enlarged circular head 20 integral with the opposite end of the shank. The foot 18 and the head 20 preferably are forged. The foot 18 includes a relatively shallow cylindrical sole portion 22 and a frusto-conical portion 24 integrally joining the sole portion to the shank 16. The head 20 includes a cylindrical end portion 26 joined integrally to the shank 16 by a frusto-conical portion 28. In practice, the said portions of the foot 18 and the head 20 may be rounded. It is preferred that the diameter of the sole portion 22 be two to three times the diameter of the shank 16. The head 20 and the shank 16 are designed for cooperation with a bifurcated or slotted hook-like structure in the lifting member, as disclosed in the aforesaid patent. Heretofore, the insert 14 has been suspended from its head 20 while a concrete slab is formed therearound. According to the present invention, the insert 14 is supported on the holder 12, furnishing a base of support and holding or locking means for the insert. In one manner of use, illustrated in FIGS. 5 and 6, the holder 12 is supported on the floor 30 of a concrete form 32 adapted for pouring a concrete slab or panel 34 or 35 therein. In another manner of use, the holder 12 similarly is supported on the upper surface of a subjacent concrete slab 35 serving as a floor for a concrete form, in casting slabs 35 one on top of another in a stack.

The holder 12 serves to support the insert 14 in an upright position, with the insert head 20 accessible from above for engagement with a lifting member. The holder 12 includes a relatively shallow box-like enclosure 36 of preferably right-rectangular configuration, four legs 38 extending diagonally outwardly and downwardly from respective corners of the enclosure, and a foot 40 at the outer end of each leg. The legs 38 and feet 40 serve to support the enclosure 36 on the feet in spaced relation above the floor 30 of the form 32.

The enclosure 36 includes a top wall 42 and a bottom wall 44, both of which are substantially horizontal in normal use, and left, right and rear side walls 46, 48 and 50, respectively, which integrally join together the top and bottom walls 42 and 44 and which extend substantially vertically in normal use. An entrance or access opening 52 to the interior of the hollow enclosure is provided on the front side 54 thereof. The entrance opening 52 is rectangular, and it is defined by the top and bottom walls 42 and 44, and the left and right side walls 46 and 48. The width of the entrance opening 52 is sufficient to accommodate the insert foot 18, being slightly greater than the diameter thereof.

An elongated slot 56 is provided in the top wall 42, and it extends from the front side 54 to a location intermediate the front side 54 and the rear side wall 50, where it terminates. The slot 56 communicates with the entrance opening 52, to accommodate the insert shank 16 as the insert foot 18 is inserted in the enclosure 36. For this purpose, the width of the slot 56 is approximately the same as the diameter of the shank 16. A semicircular edge 58 (FIG. 2) of the top wall 42 defines the inner end of the slot 56, and the edge 58 closely encompasses the insert shank 16. When the insert 14 is fully inserted into the enclosure 36, the axis of the shank 16 is substantially centered in the enclosure 36, or disposed at the vertical axis thereof. The width of the slot 56, being approximately equal to the diameter of the insert shank 16, is materially less than the width or diameter of the insert foot 18, whereby when the insert 14 is mounted on the holder 12, the foot 18 is retained between the top and bottom walls 42 and 44.

A front ledge 60 is integrally formed on the upper surface of the bottom wall 44, and it extends across the entrance opening 52 for retaining the insert foot 18 within the enclosure 36. The ledge has an inner semicircular edge 62 (FIG. 2) conforming to the periphery of the foot 18. The foot 18 is seated on the bottom wall 44 behind the ledge 60, with the sole 22 of the foot extending below the upper surface of the ledge and thereby prevented from sliding out of the entrance opening 52.

Figure 3:
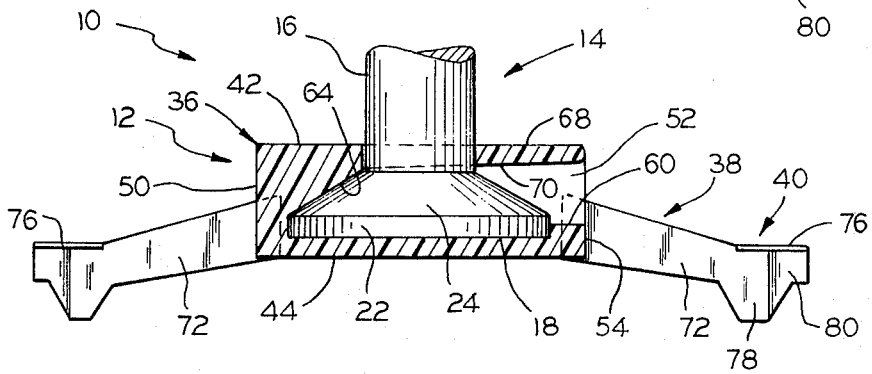
FIG. 3 is a fragmentary vertical sectional view of the assembly, taken substantially on line 3—3 of FIG. 2.
Figure 4:
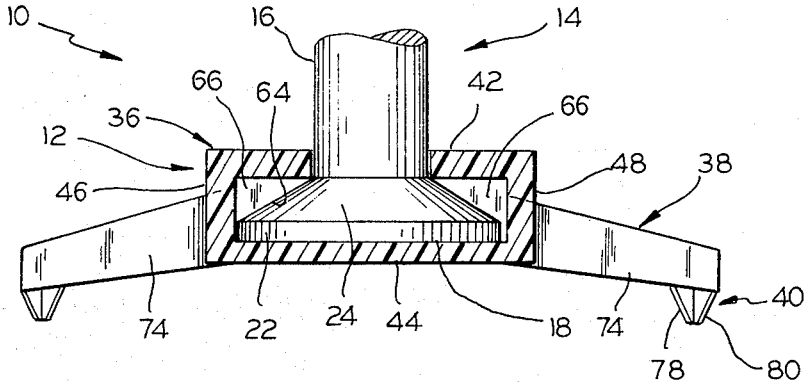
FIG. 4 is a fragmentary vertical sectional view of the assembly, taken substantially on line 4—4 of FIG. 2.

As seen in FIGS. 3 and 4, a pocket 64 substantially conforming to the configuration of the foot 18 is formed in the enclosure 36 opposite to the entrance opening 52. The pocket is formed by a web-like filling 66 of generally triangular cross section, which fills the corners formed between the top wall 42 and the left, right and rear side walls 46, 48 and 50, and also by the bottom and side walls 44, 46 48 and 50. The pocket 64 receives one-half of the insert foot 18. The fit of the foot 18 in the pocket 64 varies from a close fit to a loose fit, as variations are encountered in the manufacture of the foot. The pocket-forming means serves to limit tilting movement of the insert 14 relative to the holder 12, and the top wall 42 also serves to limit such tilting. The pocket-forming means further cooperates with the left and right side walls 46 and 48, and with the ledge 60 to restrain the foot 18 and thus the insert 14 against lateral movement off of the seat formed by the bottom wall 44.

Referring to FIG. 3, the top wall 42 of the enclosure 36 has a substantially horizontal outer surface 68 and a slightly inclined inner surface 70. The outer and inner surfaces 68 and 70 diverge rearwardly, from the entrance opening 52 to the filling 66. When the insert foot 18 is inserted in the entrance opening 52, the conical portion 24 of the foot contacts or engages the inner surface 70 of the top wall 42. As the foot 18 is moved towards the pocket 64, the conical portion 24 is cammed downwardly, so that the foot is received in the pocket and, owing to the resiliency of the top wall 42, snaps into its seated position on the bottom wall 44 and behind the ledge 60. The foot 18 is securely held in place in the enclosure 36 and requires manipulation for is removal, so that the anchor insert 14 is firmly held in position.

The legs 38 extend outwardly from the enclosure 36 on all sides thereof, in outrigger fashion. Each leg 38 includes an inside strut or flange member 72 and an outside strut or flange member 74. The struts extend substantially diagonally from the corners of the enclosure 36, and the inside and outside struts 72 and 74 of each leg 38 are spaced apart and converge towards a holder foot 40. The struts are integral at their inner ends with the enclosure 36, particularly the side walls 46, 48 and 50 thereof, and the struts extend outwardly and downwardly therefrom. The struts 72 and 74 are relatively thin flat bars or strips arranged with their wider sides extending vertically.

Each leg 38 is fixed to a holder foot 40, at the outer ends of the struts 72 and 74. Each holder foot 40 is constructed of a horizontal top plate 76 and a supporting structure of crossed vertical support plates 78 and 80. The outer ends of the struts 72 and 74 in each leg 38 are integrally joined to the support plates 78 and 80 adjacent one end of a foot 40.

While the holder 12 may be constructed of any suitable material or materials, it is especially preferred that the feet 40 thereof be constructed of non-corroding material, such as plastic, to avoid rust formation at the adjacent surface of the concrete slab 34. Preferably also, the enclosure 36 and the legs 38 are constructed of plastic material. Suitable plastic material includes thermoplastic polymers, such as polystyrene. It is further preferred that the enclosure 36, the legs 38 and the feet 40 be integral with each other, and especially, that the holder 12 be formed as a single molded plastic element. Such a holder possesses the necessary strength, resiliency and integrity, is light-weight, and is readily and economically manufactured and used in quantity. None of the parts of such a holder will corrode.

Figure 7:
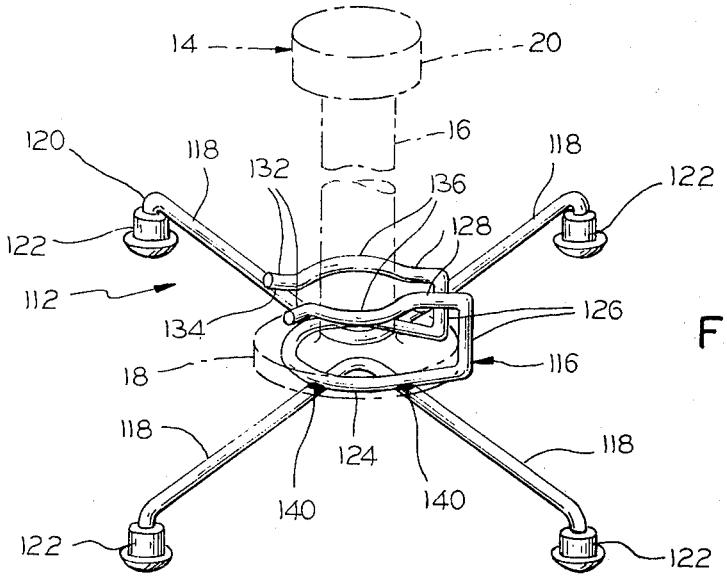
FIG. 7 is a front and side perspective view of a second embodiment of the new holder with a broken line representation of an anchor insert mounted thereon.
Figure 8:
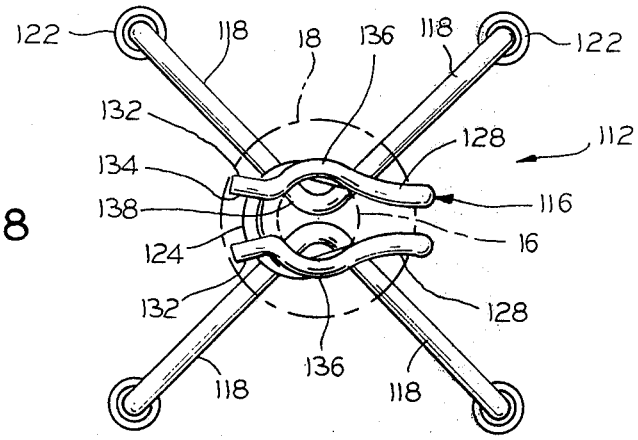
FIG. 8 is a top plan view of the second embodiment, with a broken line representation of an anchor insert mounted thereon.
Figure 9:
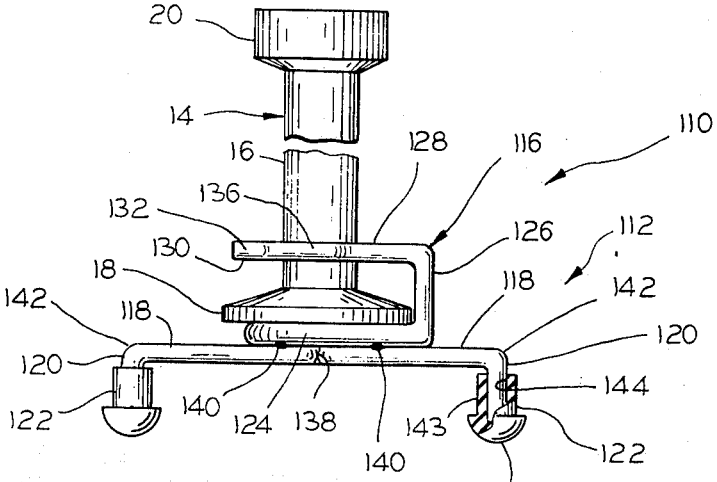
FIG. 9 is a broken side elevational view of an assembly of the second embodiment and an anchor insert mounted thereon.

FIGS. 7-9 illustrate an assembly 110 of a holder 112 and the anchor insert 14 mounted on the holder, according to a second preferred embodiment of the invention. As in the above-described assembly 10, the holder 112 serves to support the insert 14 in an upright position, with the insert head 20 accessible from above for engagement with a lifting member.

Figure 5:
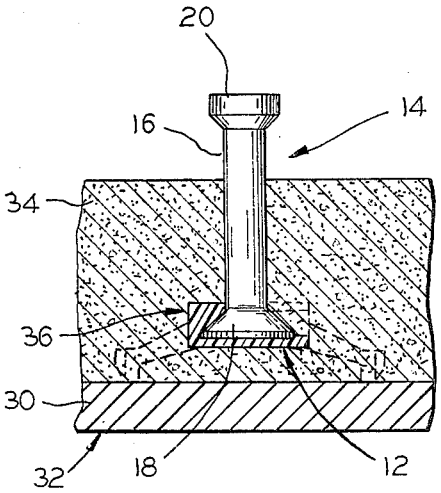
FIGS. 5 and 6 are vertical sectional views of the assembly, corresponding to FIG. 3 and shown on a reduced scale, with the assembly shown in each view as it appears when embedded in a concrete slab, the respective views illustrating alternative ways of embedding the assembly.
Figure 6:
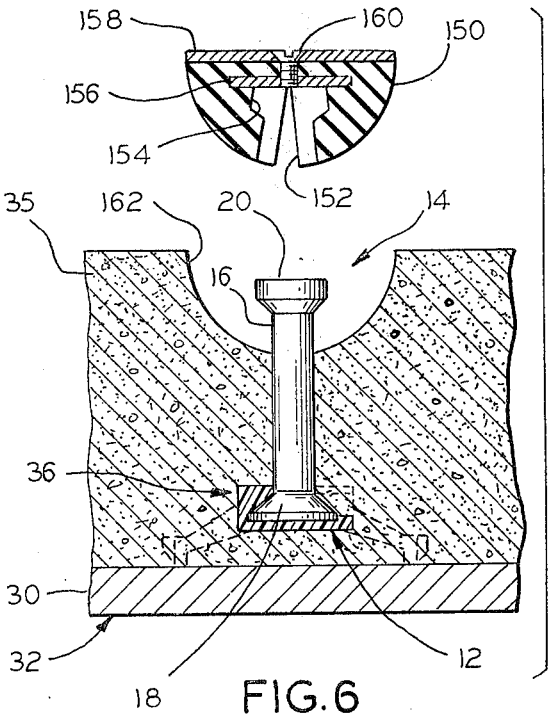
Figure 2:
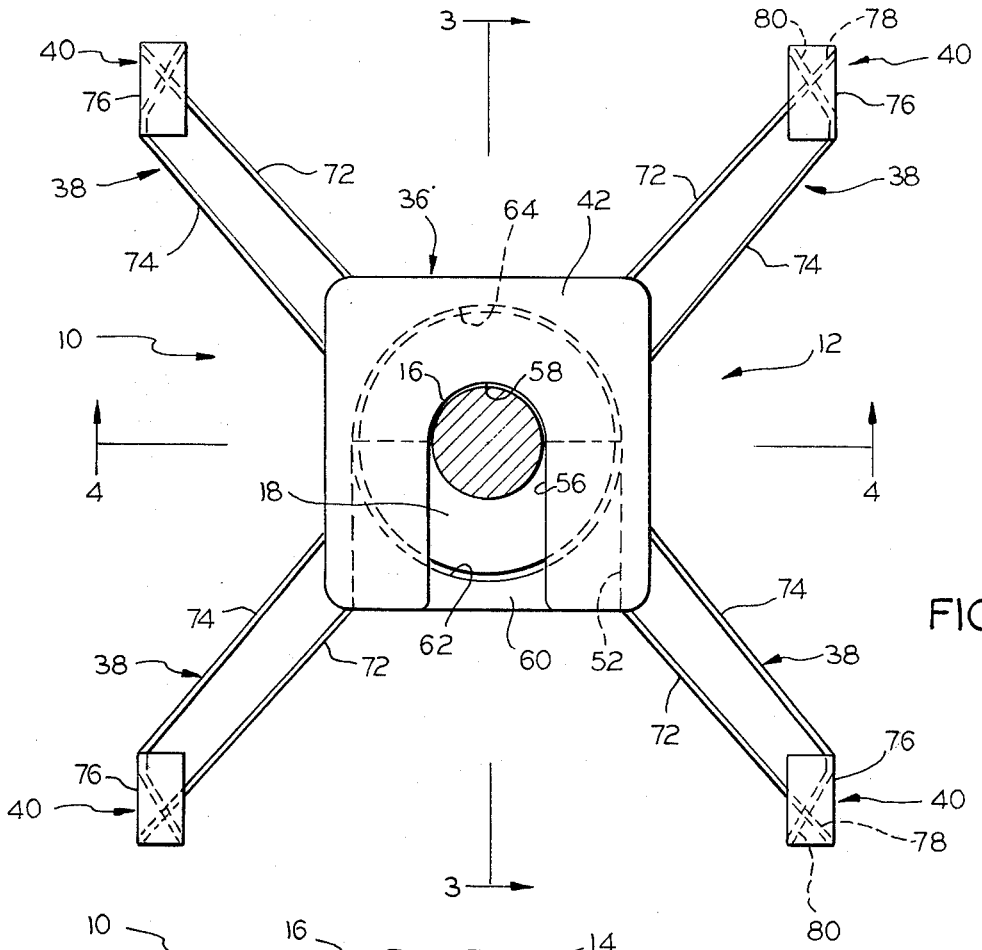
FIG. 2 is an enlarged horizontal sectional and plan view of the assembly of FIG. 1.

The holder 112 includes a wire cage-like enclosure 116, four legs 118 extending laterally outwardly from the enclosure at angles of approximately 90° to each other, a foot 120 at the outer end of each leg, and a tip or cap 122 on the end of each foot. The legs 118, the feet 120, and the tips 122 serve to support the enclosure 116 on the tips in spaced relation above the floor 30 of the form 32, similarly to the structure of the first embodiment, as illustrated in FIGS. 5 and 6.

The enclosure 116 in the preferred embodiment is formed of a single length of bent spring wire. The enclosure includes a seat section 124 of generally horseshoe-shaped or U-shaped configuration. The seat section 124 is substantially horizontal in normal use, and it is sized to provide a seat for the foot 18 of the insert 14. Two spaced-apart parallel support members or sections 126 are integral with the ends of the seat section 124 and extend upwardly therefrom at right angles thereto.

Two spaced-apart arms or arm sections 128 are integral with the outer or upper ends of the support members 126. The arms 128 extend in the same direction laterally outwardly from the support members 126, at right angles thereto, and over the seat section 124 in spaced relation thereto. The arms 128 are substantially horizontal in normal use. The seat section 124 and the arms 128 define an entrance opening 130 to the enclosure 116.

Each arm 128 is bent to provide a lip 132 at the free end thereof, and the lips diverge outwardly from each other and form a mouth 134 between them. Each arm 128 is bent adjacent to its lip 132 to provide a convex arcuate collar section 136 the inner periphery of which preferably is curved substantially on the arc of a circle corresponding substantially to the circumference of the insert shank 16. The center of curvature for both collar sections 136 substantially coincides with the center of the holder 112, or the intersection of the legs 118.

The entrance opening 130 accommodates entry of the insert foot 18 into the enclosure 116. The mouth 134 receives the insert shank 16 as the foot 18 is inserted through the entrance opening 130. The space between the lips 132 at their closest points is less than the diameter of the insert shank 16, so that the lips are spread apart upon insertion of the shank. The shank 16 is received in snap-fitting engagement between the collar sections 136, with the collar sections closely therearound. When the insert 14 is mounted on the enclosure 116 in this manner, the insert foot 18 is seated on the seat section 124 and extends substantially to the support members 126. The arms 128 are disposed in the illustrative embodiment so as to embrace the insert shank 16 at a location spaced above the foot 18. The collar sections 136 of the arms 128 are adapted to engage the insert shank 16, for limiting tilting movement of the insert 14 and for restraining the insert against lateral movement off of the seat section 124.

The holder legs 118 are integrally joined in pairs at right angle bends 138. The legs 118 are connected to the seat section 124 by welds 140, there being a weld at the intersection of each leg and the seat section. The joined pairs of legs 118 are secured on opposite sides of the seat section 124 and are to secured to each other, thereby allowing for incidental expansion of the seat section 136 when the arms 128 are spread by insertion of the insert shank 16. In the illustrative embodiment, the legs 118 extend horizontally from the seat section 24 in normal use, but they may extend outwardly and downwardly from the seat section if desired.

Each holder foot 120 is integrally joined to a holder leg 118 by a right angle bend 142, from which the foot extends vertically in normal use. the feet 120 are dimensioned according to the thickness of the concrete slab to be poured, so as to properly locate the head 20 of the insert 14 in relation to the upper surface of the slab. It is an advantage of this structure that the same die may be employed for forming combinations of legs 118 and feet 120 having various foot lengths, it being necessary only to cut the feet to the proper length after bending a wire to the required shape.

The tips 122 are conventional structures preferably made of plastic and designed to support a wire or rod so that metal is not present at the adjacent surface of a formed concrete slab, and rusting is avoided. Each tip 122 includes a tubular body 143 having a cylindrical cavity 144 therein, and a rounded supporting head 146 closing one end of the body. A holder foot 120 is received in the tip cavity 144, and the tip 122 supports the foot with the tip head 146 on the floor 30 of a concrete form 32. Alternatively, the holder feet 120 may be coated with a layer of plastic, such as by dipping in a suitable fluid plastic composition.

In using either the assembly 10 of the first holder embodiment 12 and the insert 14, or the assembly 110 of the second holder embodiment 112 and the insert 14, the assembly is arranged in multiple at spaced locations on the floor 30 of the slab form 32. The legs 38 or 118 extending outwardly in outrigger fashion provide a broad base of support and impart stability against tilting or turning over. The enclosure 36 or 116 is supported at a distance above the form floor 30, thereby spacing the enclosure and the insert 14 inwardly from the adjacent surface of the formed concrete slab. The feet 40 in the first embodiment and the tips 122 on the feet 120 in the second embodiment make little more than point contact with the form floor 30, thereby minimizing the alteration of the appearance and character of the corresponding surface of the formed concrete slab. The assemblies 10 and 110 may be wired in place, with wires extending from nearby reinforcing bars to the insert shanks 16. During the process of installing the assemblies and preparing to pour and pouring concrete, the holders 12 and 112 support the insert 14 in upright position, and they secure the insert against tilting or movement off of its seat as a result of a blow or the force of concrete being poured.

In FIGS. 5 and 6, a holder is illustrated in relation to slabs poured therearound. While the first holder embodiment 12 is illustrated in these views, the second holder embodiment 112 may be employed in like manner. Referring to FIG. 5, the insert 14 is supported by the holder 12 so that its head 20 projects from the upper surface of the slab 34, for engagement with a lifting member. When the lifting operation is complete, the projecting portion of the insert 14 may be removed, such as with a cutting torch.

The method illustrated in FIG. 6 is advantageous for embedding the insert head 20 within the slab 35 after finishing, thereby concealing the insert 14 completely and avoiding rust formation at both surfaces of the slab. This method also is used advantageously in stack-casting slabs. In this method, a conventional hemispherical rubber recess plug 150 having a central radial slit 152 extending inwardly from the crown thereof is employed to cover and enclose the insert head 20. The plug 150 is provided with an internal cavity 154 extending axially on both sides of the slit 152 to the crown of the plug. The cavity 154 conforms to the contour of the head end of the insert 14, for receiving the insert head 20 and a portion of the insert shank 16 therein. The cavity 154 also accommodates a tapped plate 156, which is inserted in the plug at the inner end of the cavity. The plug 150 may be used with a conventional circular setting plate 158, which is a relatively thin plate coextensive with the flat base of the plug, on which it is seated. The setting plate 158 has a central opening through which is inserted a countersunk screw 160. The screw 160 is inserted into threaded engagement with the tapped plate 156, for drawing together the halves of the plug 150 when it is mounted on the insert 14.

With a plug 150 secured on the head end of each insert 14, concrete is cast in the form 32 and around the holders 12, inserts 14 and plugs 150. A hemispherical recess 162 is formed in the resulting slab 35 by the plug 150. The plug 150 and the setting plate 158 provide no obstruction to screeding the slab 35, inasmuch as the upper surface of the plate lies sustantially in the plane of the upper surface of the slab, and a substantially continuous flat surface is presented. When the setting plate 158 ultimately is removed from the plug 150 and the plug is removed from the insert 14, the recess 162 affords access to the insert head 20. A lifting member such as described in the above-identified patent then may be inserted into lifting engagement with the head.

Employing the new holder for supporting the insert 14, as illustrated in FIGS. 5 and 6, the prior necessity for placing the insert in wet concrete after pouring is obviated. Screeding is permitted up to closely adjacent to the insert. When it is desired to stack-cast concrete slabs, the method of FIG. 6 may be employed. In this case, each plug 150 and its setting plate 158 are left in place after casting, to provide an even upper surface on each slab 35 for casting another slab thereon. When a stack of slabs has been cast, the setting plates 158 and the plugs 150 are removed from the inserts in the top slab, after which the slab may be lifted from the stack. The operation is repeated for each successive slab in the stack. This method eliminates the surface preparation previously necessary before casting one slab on top of another, of removing a float board to which each plug 150 was mounted, removing the plug and hardware, and filling the recess 162 with a temporary cement to provide an even surface on top of the slab. It also eliminates the need to remove the temporary cement from each recess 162 once slabs have been formed in this way, so as to provide access to the insert 14 in the recess for engagement with a lifting member.

While a preferred embodiment of the invention has been illustrated and described, it will be apparent to those skilled in the art that various changes and modifications may be made therein within the spirit and scope of the invention. It is intended that such changes and modifications be included within the scope of the appended claims.

Having thus described the invention, what I claim as new and desire to secure by Letters Patent is:

1. A holder adapted for supporting an anchor insert to be embedded in a concrete slab, said insert including a shank having an enlarged disc-like foot on one end thereof, said holder comprising, in combination:

a box-like enclosure, a plurality of legs extending laterally outwardly from said enclosure, and a foot at the outer end of each leg and adapted with the remaining feet to support the enclosure in spaced relation above the floor of a concrete form, said enclosure including a. top and bottom walls rigidly joined together by side walls, said bottom wall being adapted for supporting said insert with the foot of the insert seated thereon, b. means defining an entrance opening for lateral insertion of said foot into the enclosure to seat on said bottom wall, c. a ledge on said bottom wall extending across said entrance opening for retaining said foot within said enclosure, d. means in said enclosure forming a pocket opposite to said entrance opening and substantially conforming to the configuration of said foot, said pocket-forming means serving to limit tilting movement of the insert relative to the holder, and e. means defining a slot in said top wall communicating with said entrance opening to accommodate the shank of said insert as said foot is inserted in said enclosure, said slot having a width less than the width of said foot.

2. A holder as defined in claim 1 wherein said enclosure, legs and feet together constitute a single molded plastic element.

3. A holder adapted for supporting an anchor insert to be embedded in a concrete slab, said insert including a cylindrical shank having an enlarged disc-like foot on one end thereof, said holder comprising, in combination:

a wire cage-like enclosure, and wire members providing a plurality of legs extending laterally outwardly from said enclosure and terminating in feet adapted to support the enclosure in spaced relation above the floor of a concrete form, said enclosure including a. a normally substantially horizontal wire seat section adapted for supporting said insert with the foot of the insert seated thereon, b. two spaced apart normally substantially horizontal wire arms arranged for insertion of the shank of said insert between adjacent free ends thereof and being bent substantially on the arc of a circle for conforming substantially to the circumference of the shank, to thereby engage the shank between them for limiting tilting movement of the insert when supported on said seat section and for restraining the insert against lateral movement off of the seat section, and c. wire support members fixedly connecting said arms to said seat section for supporting said arms on said seat section in spaced relation thereto.

4. A holder as defined in claim 3 and including plastic tips on the ends of said feet.

5. A holder as defined in claim 3 and wherein said enclosure is formed of a single length of bent wire.

* * * * *